US006138283A

United States Patent [19]

Kress

[11] Patent Number: 6,138,283

[45] Date of Patent: Oct. 31, 2000

[54] PROTECTIVE HELMET WITH MEDICAL EMERGENCY REMOVAL FEATURE

[76] Inventor: James R. Kress, 511 W. Tenth St., Erie, Pa. 16502

[21] Appl. No.: 09/038,952

[22] Filed: Mar. 10, 1998

[51] Int. Cl.[7] ..... A42B 3/00

[52] U.S. Cl. ..... 2/411; 2/424; 2/425

[58] Field of Search ..... 2/410, 411, 412, 2/421, 422, 424, 425

[56] References Cited

U.S. PATENT DOCUMENTS

| | | | |
|---|---|---|---|
| 1,280,684 | 10/1918 | Domanski | 2/6.6 |
| 3,943,571 | 3/1976 | Boatman | 2/421 |
| 3,987,495 | 10/1976 | Holley | 2/410 |
| 4,477,929 | 10/1984 | Mattsson | 2/425 |
| 4,665,569 | 5/1987 | Santini | 2/425 |
| 4,903,346 | 2/1990 | Reddemann et al. | 2/414 |
| 4,955,089 | 9/1990 | Beale | 2/410 |
| 5,428,845 | 7/1995 | Deagan | 2/413 |
| 5,628,071 | 5/1997 | Nezer | 2/410 |
| 5,787,513 | 8/1998 | Sharmat et al. | 2/411 |

FOREIGN PATENT DOCUMENTS

| | | | |
|---|---|---|---|
| 183588 | 6/1986 | European Pat. Off. | 2/411 |
| 2422348 | 12/1979 | France | 2/410 |
| 2422349 | 12/1979 | France | 2/410 |
| 2817528 | 3/1979 | Germany | 2/410 |
| 2912048 | 10/1980 | Germany | 2/411 |
| 3025770 | 2/1982 | Germany | 2/425 |
| 3214020 | 7/1983 | Germany | 2/411 |
| 3727701 | 3/1989 | Germany | 2/425 |

*Primary Examiner*—Michael A. Neas
*Attorney, Agent, or Firm*—Richard K. Thomson

[57] ABSTRACT

A multiple-piece removable helmet can be disassembled on the wearer's head so that, in the event of a medical emergency, the front portion can be removed to afford access to the face of the wearer for administration of first aid and to facilitate the diagnosis of the extent of the injury. A neck brace can be attached and the injured can be lifted out of the back portion of the helmet. Apparatus for removably attaching the two halves include, in various embodiments, screws, adjustable tension cables, buckles, and spring fingers on one half engaging in indentations in the other with the fingers being secured in place by screws.

13 Claims, 9 Drawing Sheets

PROTECTIVE HELMET WITH MEDICAL EMERGENCY REMOVAL FEATURE

BACKGROUND AND SUMMARY OF THE INVENTION

The present invention is directed to improvements in protective headgear. More particularly, the present invention is directed to a helmet which can be removed in an emergency situation without excessive movement of the wearer's head to avoid exacerbating possible head, neck or spinal injuries.

Protective headgear is worn by various athletes including but not limited to football players, race car drivers, motorcyclists, bikers, hockey players, skate boarders, and ski racers. In spite of efforts to protect the head of the wearer, occasionally a sports participant undergoes a head, neck or spinal injury. In such cases, it is extremely important that the head not be moved until the nature and extent of the injury can be diagnosed. Simultaneously, it is just as critical that the head gear be removed quickly should CPR be necessary and to enable the diagnosis to be carried out quickly so proper medical attention can be administered promptly. Conventional headgear requires the head of the wearer to be raised and an axial pull force, and associated frictional force, exerted to effect removal. Such movement of a patient's head is exactly the type of movement that could turn a relatively minor injury into a permanent disability.

Within the last several months, several severe injuries and, in some cases, deaths, have occurred due to head and/or spinal injuries to participants in sporting events. It is possible that one or more of the injuries may have been aggravated by the need to remove the wearer's helmet in order to administer first aid. The present invention provides a multiple-piece helmet design, the parts of which can be disassembled and removed from the head of its wearer while minimizing movement of the athlete's head and spinal column.

A first rigid portion is attached to a second rigid portion, preferably first and second halves, by a securing means that may be detached in the event of an emergency. The securing means can take any of a variety of forms including, but not limited to buckles, pronged fingers and recesses with fasteners, threaded fasteners alone, and a woven wire. The portions are most preferably a front half and a back half. In a medical emergency, the front half can be removed while the player is lying on her/his back, the patient fitted with a supporting collar and simply lifted out of the back half. In this way, cervical strain and range of motion (ROM) of the head, neck and spine to effect removal of the helmet are greatly reduced. While the present invention deals only with the external portions of the helmet, it will be understood that the internal liner will similarly need to be made in multiple pieces. These pieces can be most easily made separable through simply overlapping tapered soft liner portions. As an alternative, the liner may be equipped with VELCRO fasteners on the interface between the multiple pieces or two halves, as depicted in the drawings.

The securing means can take a variety of forms and several embodiments are shown. In a first embodiment, the securing means comprises a plurality of buckles, one section formed on each helmet portion, and one of the sections being relatively movable with respect to the helmet to permit the plurality of buckles to be affixed seriatim. A second embodiment depicts the securing means as a plurality of fasteners threaded directly into a layer from one of the helmet halves that underlies the other helmet half. A series of interdigitating fingers, pins in recesses, or a tongue-in-groove arrangement is provided to supply the needed alignment and joint reinforcement necessary.

A third and fourth embodiment of the present invention utilize a tension wire wound through interdigitating helmet portions which may include reinforcing steel pins. A first end of the wire is received in a recess and the opposite end is adjustable to remove the slack and adjust the tension in the wire as the tension in the wire, over time, produces stretching or creep. A fifth embodiment employs a latching between a series of pronged fingers on a first helmet half and a series of recesses or indentations on the second half, with fasteners insuring securement of the fingers in the indentations.

Other features, advantages and characteristics of the present invention will become apparent to a person of ordinary skill in the art following a reading of the following specification.

BRIEF DESCRIPTION OF THE DRAWING

The preferred embodiments are described in conjunction with the attached drawings, like elements bearing like reference numerals and, in which.

DETAILED DESCRIPTION OF THE PREFERRED EMBODIMENTS

Figure 1:
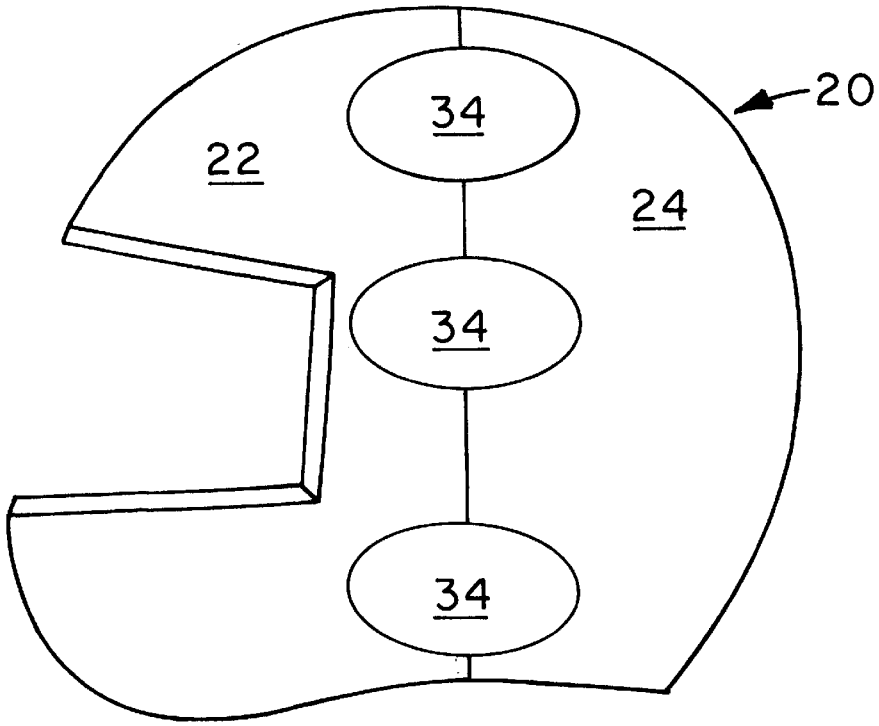
FIG. 1 is a side view of a first embodiment of the two-piece helmet of the present invention.
Figure 2:
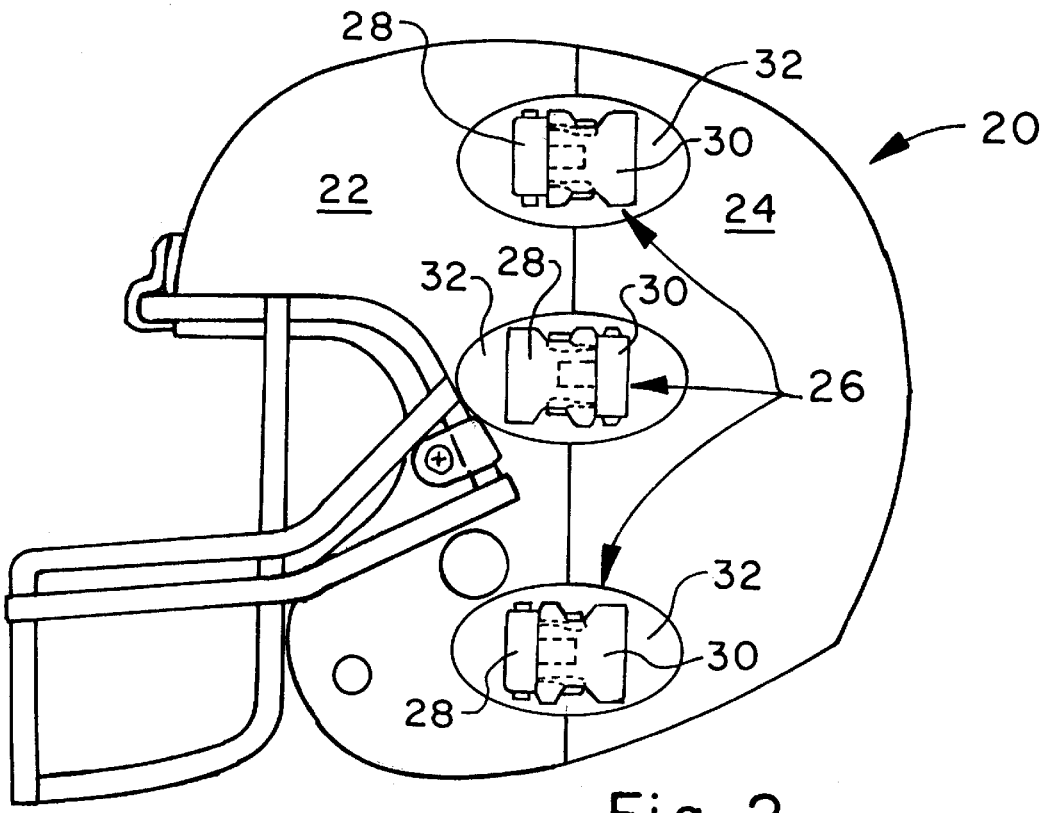
FIG. 2 is a side view similar to FIG. 1 shown on a different style helmet with the dust covers removed.
Figure 3:
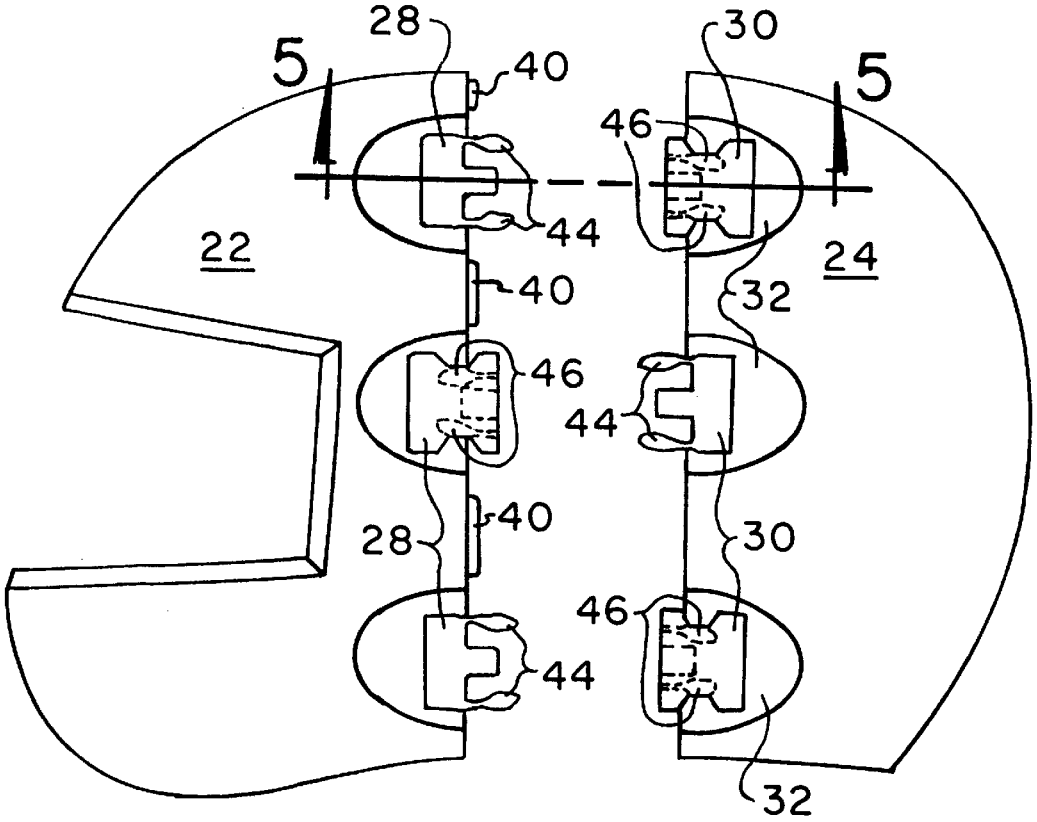
FIG. 3 is a side view of the first embodiment with the two-halves disengaged.

The first embodiment of the present invention is shown in FIGS. 1–4 generally at 20. Helmet 20 is comprised of first portion (or half) 22 and second portion 24. The two halves 22 and 24 engage along a seam which preferably extends across the wearer's head from ear to ear. Securing means 26, in this case a plurality of buckles consisting of first buckle half 28 secured to front half 22 and second buckle half 30 secured to rear half 24, are used to attach the two halves 22 and 24 together for conventional use and wear. Alternate buckle halves 28 are mounted on a track 29 (FIG. 5) to permit it to be slid toward and away from buckle half 30 to facilitate assembling and disassembling of the halves 22 and 24. The other alternate buckles 26 have the buckle half 30 movable to facilitate secure attachment (FIG. 3). The buckles are connected by pushing the arms 44 of a first buckle half into the recesses 46 of a second buckle half.

Figure 4:
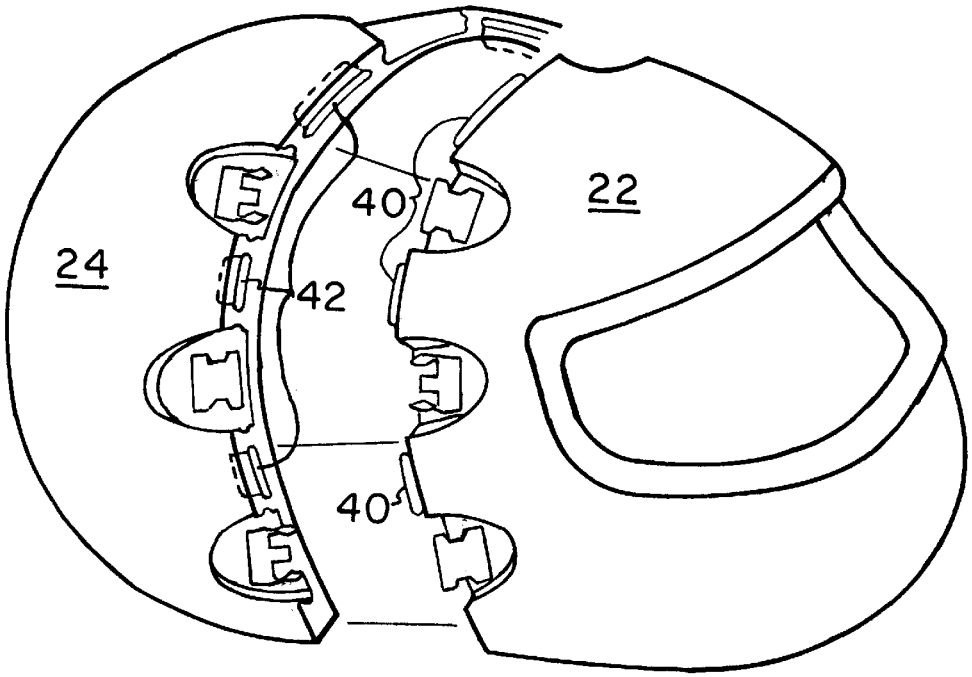
FIG. 4 is a perspective view of the first embodiment with the halves disengaged.
Figure 5:
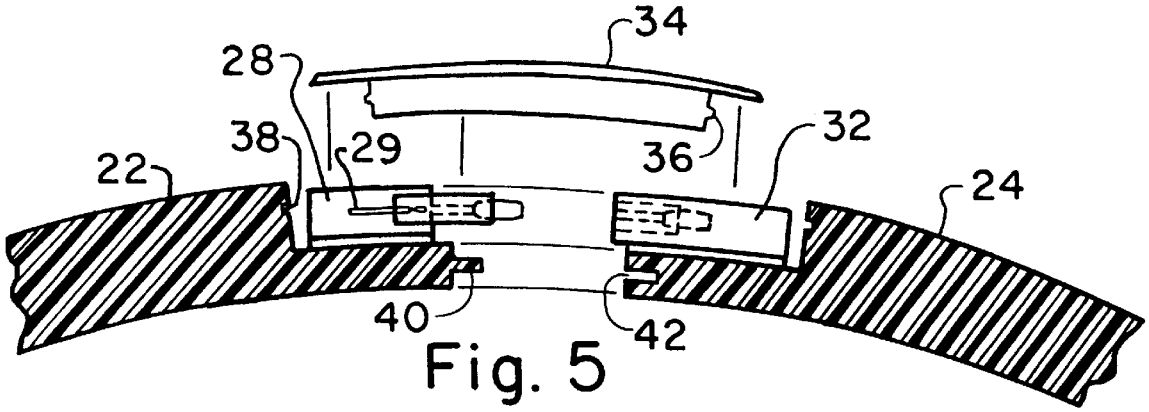
FIG. 5 is a cross-sectional side view of the first embodiment as seen along line 5—5 in FIG. 3.

The principles of the invention are equally applicable to the race car style helmet depicted in FIG. 1 and the football helmet of FIG. 2. The buckles 26 are positioned in recesses 32 (FIG. 5) and enclosed by dust covers 34 which keep dirt, sod, and other material out of the recesses 32 where it could possibly foul the workings of the buckles 26. Dust covers 34 each have an annular protrusion 36 which snaps into a groove 38 extending about the periphery of recess 32. While any number of buckles 26 can be used, six have been depicted here. It is believed that the minimum number required would be three. As seen in FIG. 4, a plurality of extensions 40 are formed on front half 22 that are received in openings 42 in back half 24. Engagement between extensions 40 and openings 42 are needed to provide the structural rigidity needed to permit the helmet 20 to withstand the impact testing required for a helmet to be certified for use.

After the front (22) and rear (24) portions are assembled at the factory, the helmet 20 will be used as a conventional helmet, being slipped on and off with repeated uses. Should the helmet's wearer undergo a head, neck or spinal injury, s/he can be laid on her/his back, the dust covers 34 snapped off with a screw driver or other blunt instrument, the buckles 26 unfastened, and the front portion 22 removed by lifting it off the rear portion 24. This will provide those administering first aid access to the wearer's face and facilitate the attachment of a supportive neck brace, if necessary. Once the wearer's head has been stabilized, they can simply be lifted out of the rear portion and placed on a gurney for transport to the hospital. As an alternative, the wearer's head can remain in the rear portion 24 to help keep the head in a neutral position.

Figure 6:
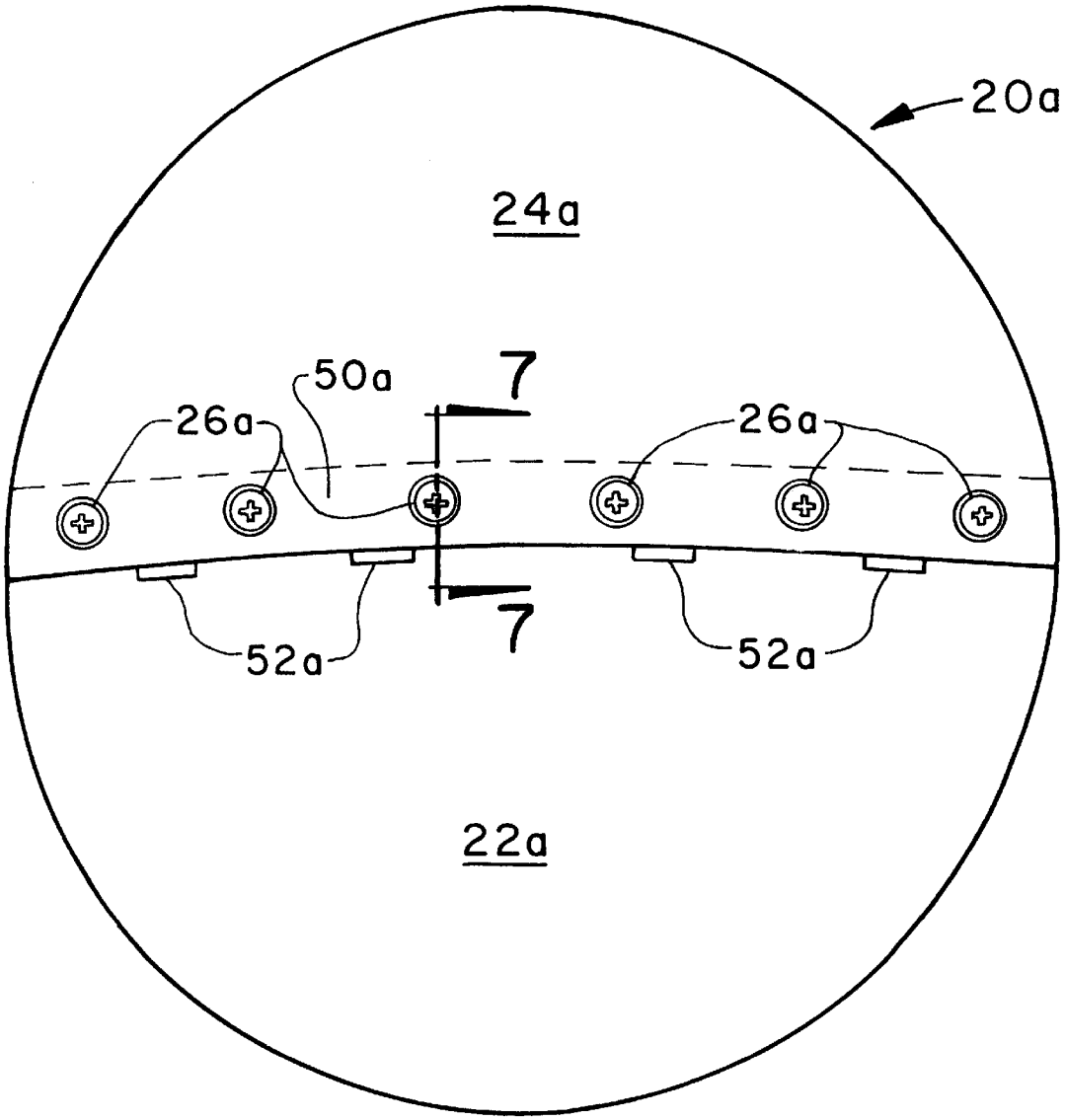
FIG. 6 is a top view of a second embodiment of the two-piece helmet of the present invention.
Figure 7:
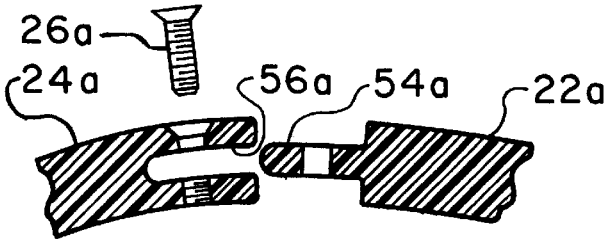
FIG. 7 is an exploded cross-sectional side view of the second embodiment as seen along line 7—7 in FIG. 6.

A second embodiment of the present invention is shown in FIGS. 6 and 7 generally at 20*a*. In this embodiment, a plurality of threaded fasteners 26*a* are positioned about the periphery of the helmet along the seam 50*a*. It is preferred that the fasteners 26*a* be spaced apart by about 1½ to 2 inches. While seam 50*a* could be formed by overlapping flanges which are each ½ the thickness of the full helmet, in this embodiment, a tongue in groove configuration has been shown. A plurality of slots 52*a* are positioned in the front portion 22*a* of helmet 20*a* to permit it to be pried off the rear portion 24*a* by a screw driver, or the like. As seen in FIG. 7, tongue 54*a* on front portion 22*a* is received in groove 56*a* in rear portion 24*a* and secured there by screws 26*a* which thread into the lower flange of groove 56*a* to retain the two halves 22*a*, 24*a* together. The design could be simplified by having a half-thickness flange on one of the two halves 22*a*, 24*a* underlie a half thickness flange on the other. In the event of an emergency, the wearer can again be positioned on her/his back and the screws 26*a* removed using a cordless power screwdriver so that the front portion 22*a* can be quickly pried off the rear portion 24*a* and access gained to the wearer's face.

Figure 8:
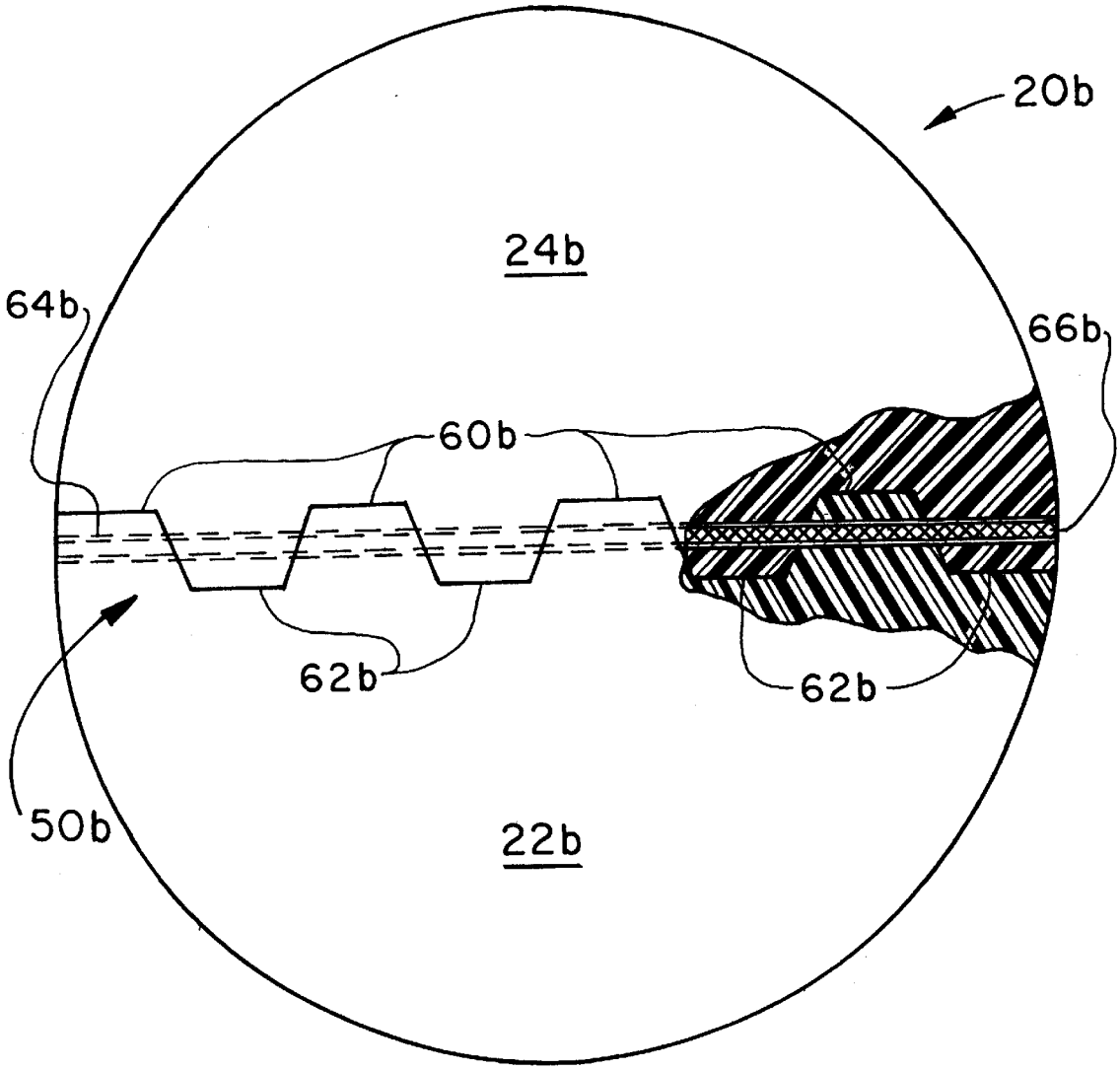
FIG. 8 is a top view with portions removed of a third embodiment of the present invention.
Figure 8A:
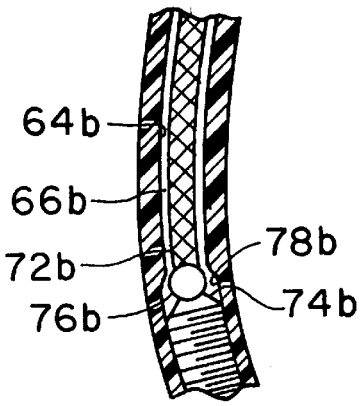
FIG. 8A is detailed cross-sectional side view of a first side of the third embodiment.
Figure 8B:
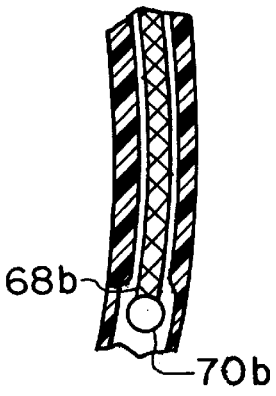
FIG. 8B is a detailed cross-sectional side view of a second side of the third embodiment.

A third embodiment is depicted in FIGS. 8, 8A, and 8B generally at 20*b*. In this embodiment, seam 50*b* is formed by a first series of gear teeth 60*b* on helmet front portion 22*b* and a second series of gear teeth 62*b* on helmet rear portion 24*b*. These teeth 60*b* and 62*b* interdigitate as shown in FIG. 8. A recess 64*b* extends laterally through the teeth 60*b*, 62*b* and preferably, a tongue-and-groove engagement (not shown) of the type depicted in conjunction with the first embodiment occurs between the ends of gear teeth 60*b*, 62*b* and the corresponding recesses that receive them. A wire or cable 66*b* is threaded through recess 64*b* to secure front portion 22*b* to rear portion 24*b*. Once cable 66*b* is threaded, ball stop 70*b* will be affixed to the end 68*b* of cable 66*b*. This may be done by swaging or, more preferably, by threading. The opposite end 72*b* has an adjustment screw 74*b* attached by means of a swivel 76*b*. Adjustment screw 74*b* engages threads in enlarged opening 78*b* which can be directly formed in the plastic of the enlarged opening 78*b* or in a metallic insert (not shown) swaged into opening 78*b*. A screw driver can be inserted into a slot formed in the end of adjustment screw 74*b* to permit the cable 66*b*to be tensioned to properly attach the front portion 22*b* to the rear portion 24*b* even should the cable 66*b* stretch.

In this third embodiment, should an emergency occur, adjustment screw 74*b* can be fully loosened and swaged ball stop 70*b* snipped off the end or threaded ball 70*b* unscrewed. Then adjustment screw 74*b* can be completely backed out of opening 78*b* and the cable removed. Then, front portion 22*b* can be lifted off rear portion 24*b* to permit access to the wearer's face.

Figure 9:
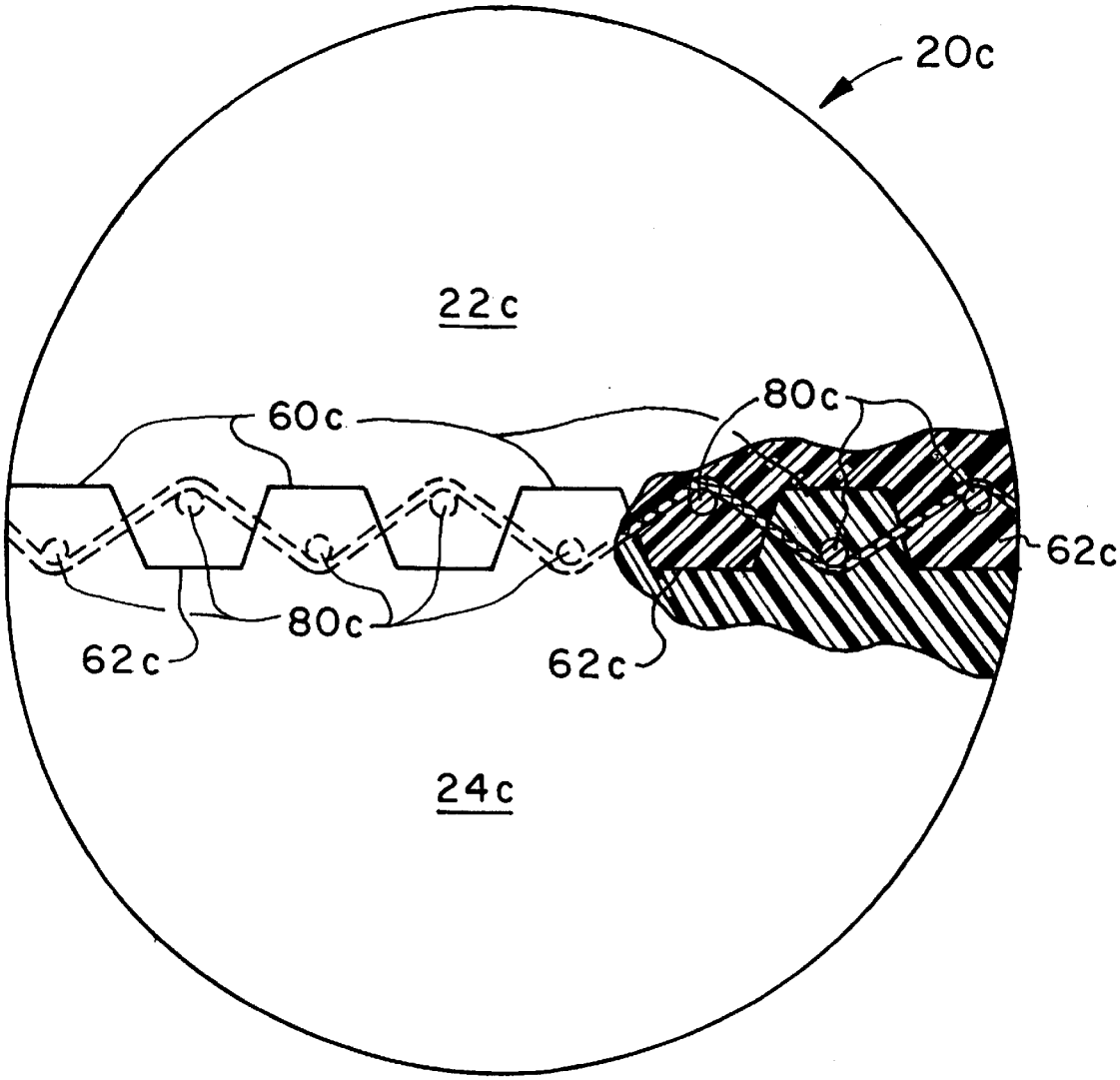
FIG. 9 is a top view with portions removed of a fourth embodiment of the present invention.
Figure 9A:
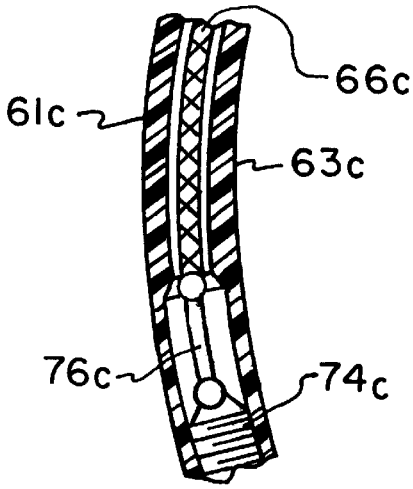
FIG. 9A is a detailed cross-sectional side view of a side portion of the fourth embodiment.

A fourth embodiment is depicted in FIGS. 9 and 9A generally at 20*c*. Cable 66*c* is wound around a plurality of steel pins 80*c* which extend between layers of plastic 61*c* and 63*c* which form gear teeth 60*c* and 62*c*. Again, an adjustment screw 74*c* which is mounted by means of swivel 76*c* allows the tension to be adjusted in cable 66*c* by pulling against a ball stop (not shown) to afford the proper retention force between helmet halves 22*c* and 24*c*. To assemble this embodiment, the cable 66*c* will be wound around the pins 80*c* with the two halves 22*c*, 24*c* slightly separated to afford access to the slots around the pins. Tongue-in-groove engagement between the bottom of the gear slots and the ends of the teeth will provide the reinforcement for stability as in the previous embodiment. Removal is effected by adjusting the screw 74*c* as was described above in conjunction with the other cable embodiment.

Figure 10:
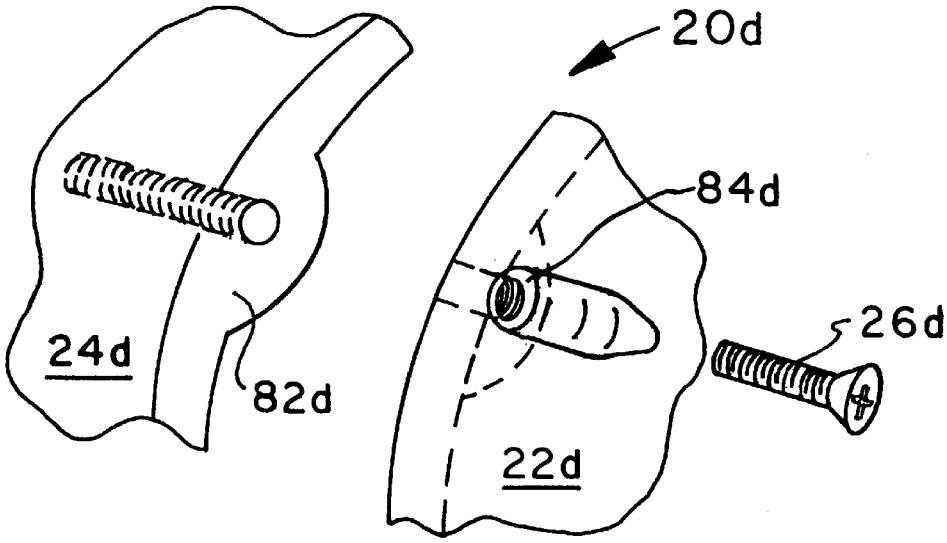
FIG. 10 is a detailed perspective of a first variant of the present invention.

A first variant of the present invention is depicted in FIG. 10. Instead of having threaded fasteners extending radially inwardly through the layers of the two helmet halves as depicted in conjunction with FIGS. 6 and 7, a molded recess 82*d* could be formed in the rear half 24*d* of the helmet 20*d* and an apertured rib 84*d* formed on the front half 22*d*. In this way, the fasteners 26*d* extend circumferentially about the helmet 20*d*. It is preferred that the recess 82*d* be in the rear half 24*d* of the helmet so that the screws 26*d* can be removed while the wearer is lying on her/his back.

Figure 11:
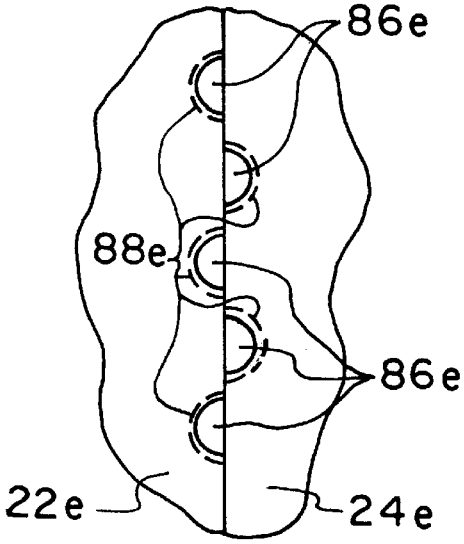
FIG. 11 is a side view of a detail of a second variant of the junction between the two helmet halves.
Figure 12:
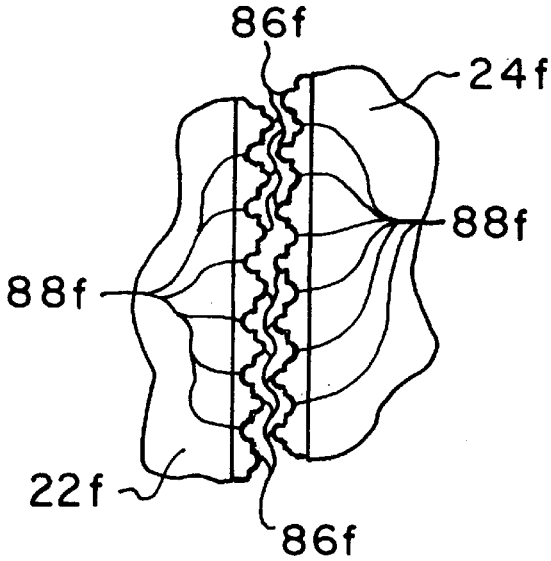
FIG. 12 is a side view of a detail of a third variant of the junction.
Figure 13:
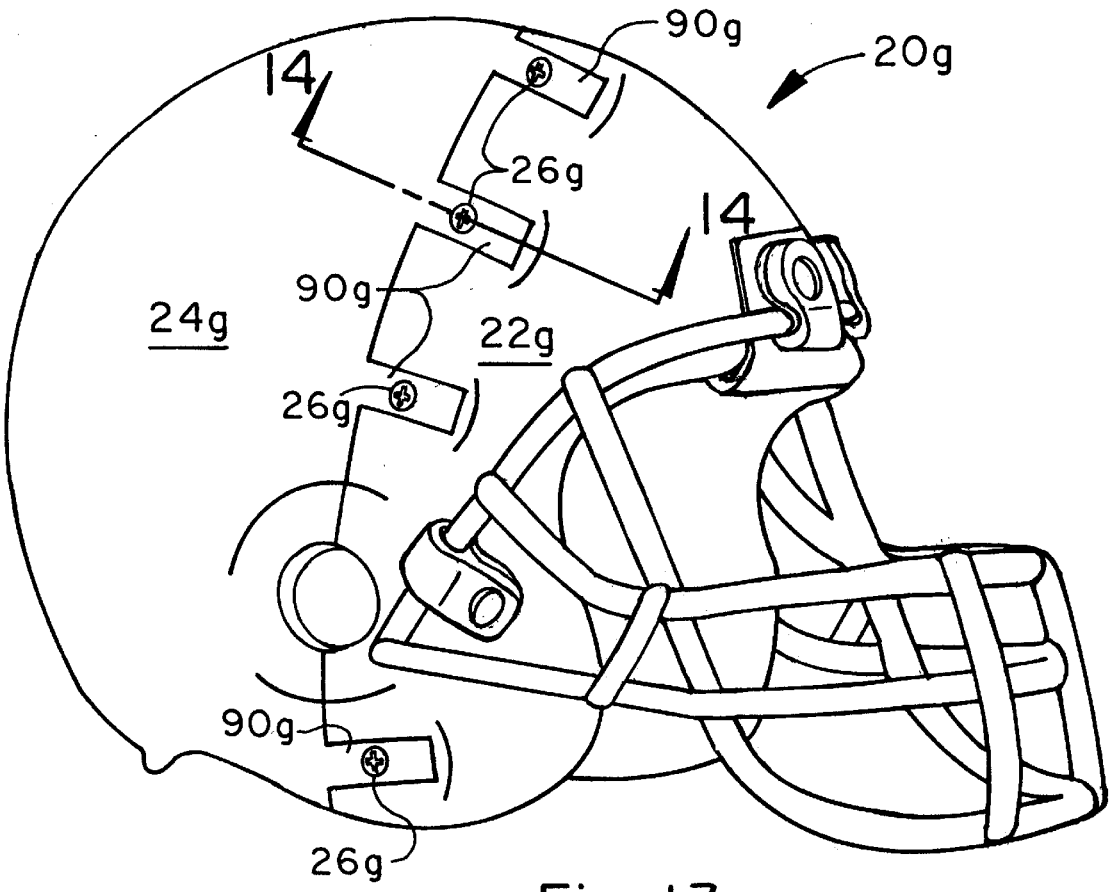
FIG. 13 is a perspective view of a fifth embodiment of the two-piece helmet of the present invention.
Figure 14:
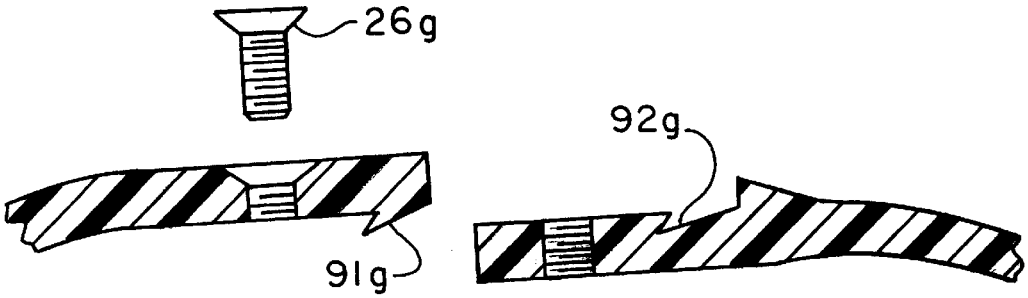
FIG. 14 is a sectional view of the fifth embodiment as seen along line 14—14 of FIG. 13.
Figure 15A:
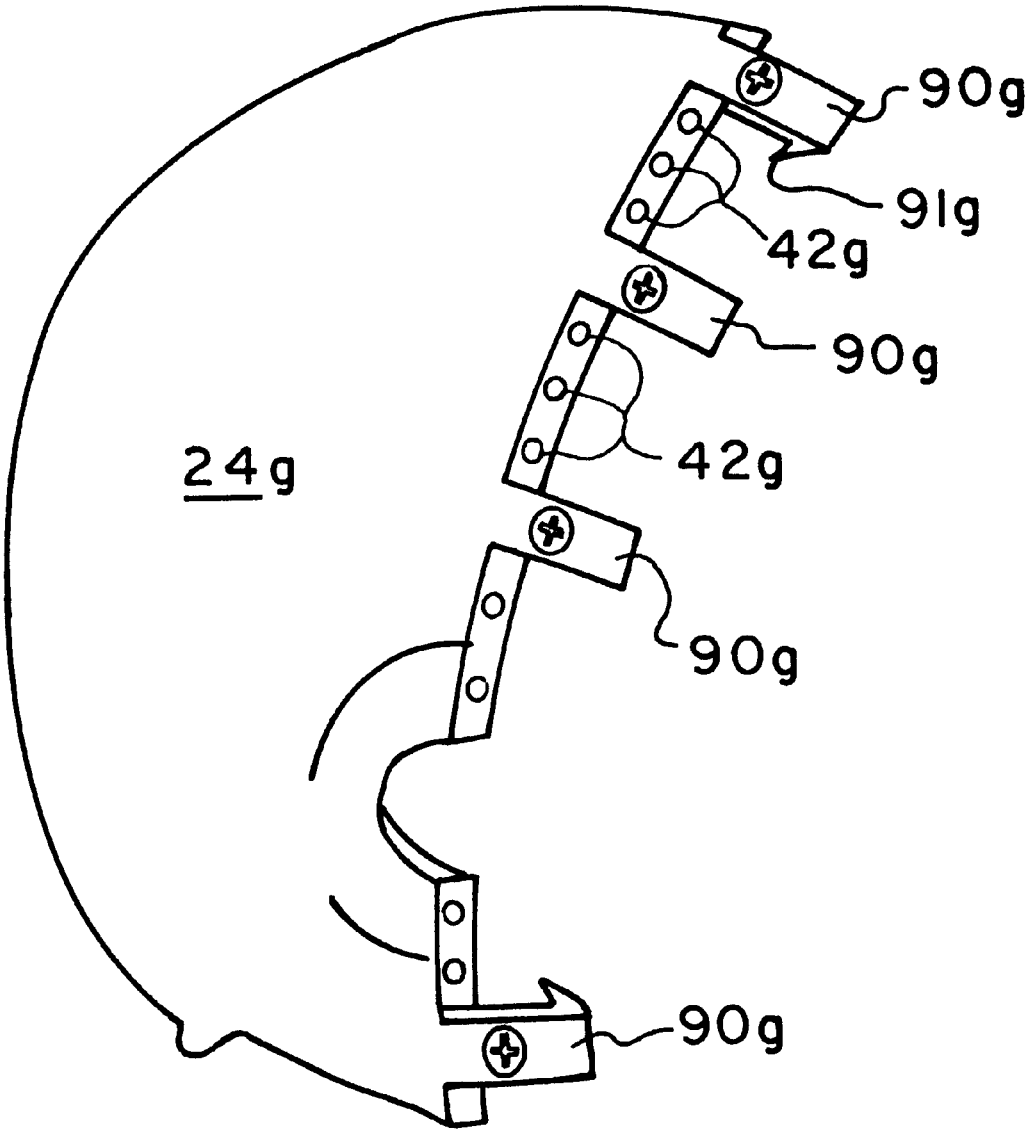
FIG. 15A is a perspective of the back half of the helmet of the fifth embodiment.
Figure 15B:
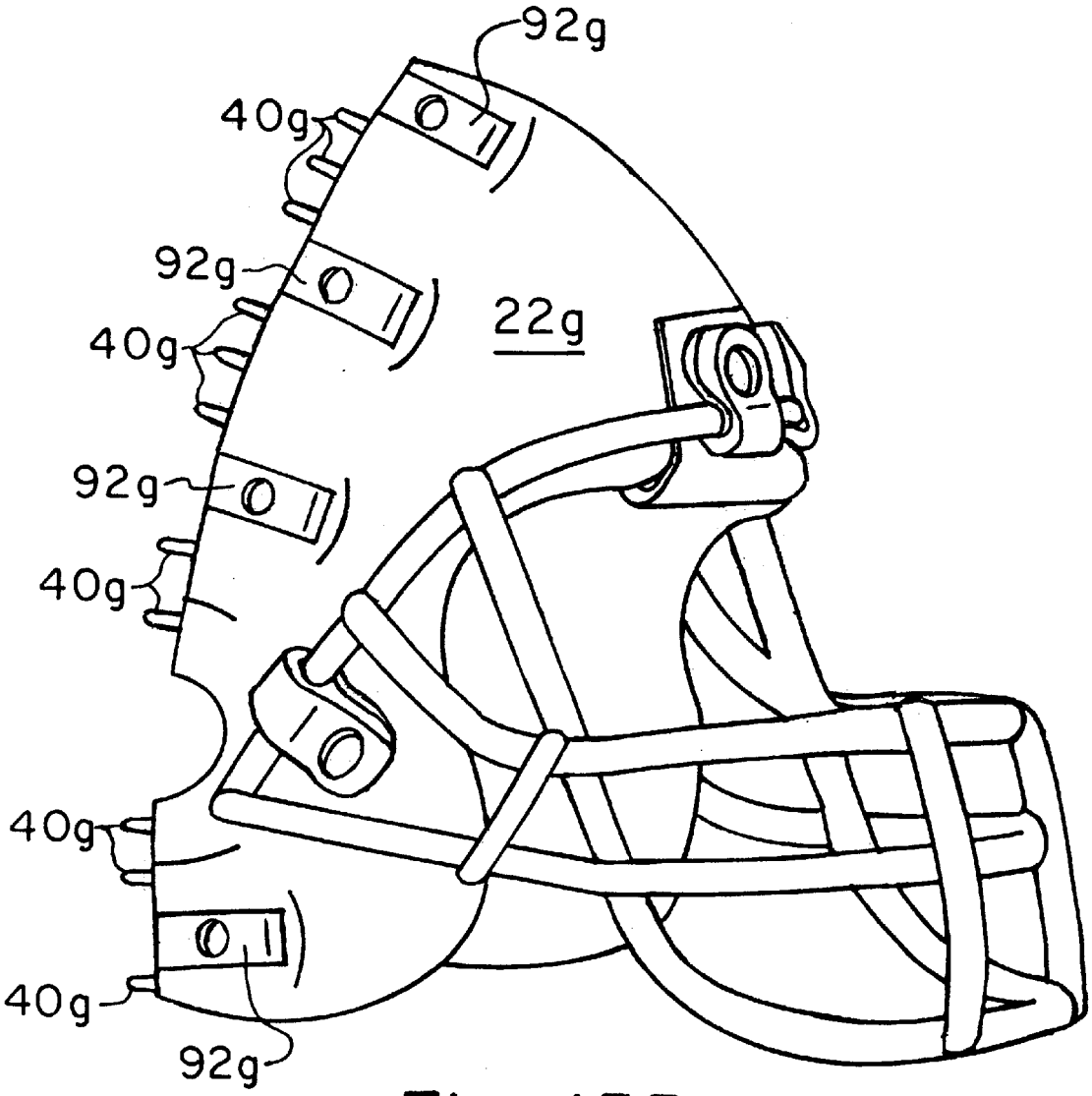
FIG. 15B is a perspective of the front half of the helmet of the fifth embodiment.

A second variant of the present invention is depicted in FIG. 11. Spherical protrusions 86*e* are received in spherical recesses 88*e* to provide the alignment of the two halves 22*e* and 24*e*, prevent rotational misalignment between the two halves and to provide the reinforcement needed to pass the structural integrity tests. Yet a third variant is depicted in FIG. 12 in which the protrusions 86*f* and recesses 88*f* are more intricately shaped and more resistant to slippage.

A fifth embodiment of the present invention is shown in FIGS. 13, 14, 15A and 15B generally at 20*g*. In this embodiment, a series of spring fingers 90$g$, with prongs 91$g$, extending from rear half 24$g$ engage in a series of indentations 92$g$ in the front half 22$g$ and are secured there by screws 26$g$. A series of pins 40$g$ in one half are received in holes 42$g$ (FIGS. 15A, 15B) in the other to provide the alignment and reinforcing functions. To remove the helmet 20$g$ in an emergency medical situation, screws 26$g$ are removed using a cordless power tool and the fingers 90$g$ pried outwardly to permit front half 22$g$ to be lifted off rear half 24$g$.

Several embodiments of the present invention have been shown in which a two-piece helmet can be disassembled while on the wearer's head in order to avoid aggravating a possible head, neck or spinal injury. Various changes, alternatives and modifications will become apparent to one of ordinary skill in the art after a reading of the foregoing specification. It is intended that all such changes, alternatives and modifications as fall within the scope of the appended claims be considered part of the present invention.

I claim:

1. A multiple-piece helmet for protecting a head region of its wearer and providing emergency removal, said helmet comprising:

a) a rigid first helmet portion, said first portion having first protruding means extending from an inwardly extending section thereof and a first outer surface;

b) a separate rigid second helmet portion, said second portion having second protruding means extending from an inwardly extending section thereof and a second outer surface, said second protruding means extending from said inwardly extending section of said second helmet portion engaging said first protruding means extending from said inwardly extending section of said first helmet half;

c) securing means extending between said first helmet portion and said second helmet portion holding said two halves together in a releasable manner said securing means lying entirely below said first and second outer surfaces;

whereby, should a wearer of said helmet incur a head, neck or spinal injury, said securing means can be disengaged to permit said first and second helmet portions to be disassembled and removed without need for significant movement of the wearer's head by pulling said first helmet portion directly laterally away from said second portion to completely disengage said first portion from said second portion without any pivotal movement.

2. The helmet of claim 1 wherein said first and second helmet portions are generally first and second helmet halves one of said first and second helmet halves having a plurality of extensions, said other of said first and second halves having a plurality of openings, said plurality of extensions being received in said plurality of openings to provide said helmet with the structural rigidity needed to withstand required testing.

3. The helmet of claim 1 wherein an engagement between said first and second helmet halves forms a seam extending across the wearer's head in an ear-to-ear direction.

4. The helmet of claim 1 wherein said protruding means comprises flange means formed on one of said first and second inwardly extending sections of said first and second helmet portions and flange means formed on another of said first and second inwardly extending sections of said first and second helmet portions, one of said first and second flange means at least partially overlying the other.

5. The helmet of claim 1 wherein said protruding means comprises a plurality of gear tooth like fingers, said fingers on said first helmet portion interdigitating with the fingers on said second helmet portion, each gear tooth like finger having sides which taper proceeding along each said inwardly extending section.

6. The helmet of claim 5 wherein said securing means comprises a wire threaded through said interdigitated fingers to retain said helmet portions together, one end of said wire having means to adjust a level of tension in said wire to take up slack due to stretching.

7. The helmet of claim 6 wherein said means to adjust said level of tension in said wire comprises a ball affixed to a first end of said wire and an adjustment screw attached by means of a swivel to a second opposite end of said wire whereby said second end can be moved relative to said first end to adjust said tension.

8. The helmet of claim 6 wherein said wire is woven around a plurality of steel pins extending between two layers of plastic which make up said gear tooth like fingers, each said finger having diverging faces.

9. The helmet of claim 1 wherein said securing means comprises a threaded fastener and said first protruding means comprises a first region having an increased thickness which receives a threaded aperture which threadingly engages said threaded fastener, said second protruding means comprises a second enlarged region having the form of an apertured rib which seats a head portion of said threaded fastener and receives a shank portion of said fastener said fastener extending generally circumferentially about said helmet.

10. The helmet of claim 1 wherein said securing means comprises a first plurality of first buckle portions secured to said first helmet portion and a second plurality of second buckle portions movably secured to said second helmet portion by means of tracks whereby said second buckle portions may be sequentially axially slid relative to and engaged with said first buckle portions to secure said two helmet portions together and sequentially axially slid relative to and disengaged from said first buckle portions to permit removal of said first rigid helmet portion and subsequent removal of said second helmet portion from its wearer in an emergency situation.

11. The helmet of claim 10 further comprising a plurality of dust covers which may be snapped into recesses in said helmet formed adjacent said buckle portions, said dust covers not extending significantly above a normal curvature of said helmet and overlying said buckle portions to exclude dirt from said buckles and prevent undesired disengagement.

12. The helmet of claim 1 further comprising a plurality of dust covers which may be snapped into recesses in said helmet formed adjacent said securing means, said dust covers not extending significantly above a normal curvature of said helmet and overlying said securing means to exclude dirt from said securing means and prevent undesired disengagement.

13. A multiple-piece helmet for protecting a head region of its wearer and providing emergency removal, said helmet comprising:

a) a rigid first helmet portion, said first portion having first protruding means extending from an inwardly extending section thereof;

b) a rigid second helmet portion, said second portion having second protruding means extending from an inwardly extending section thereof, said second protruding means extending from said inwardly extending section of said second helmet portion engaging said first protruding means extending from said inwardly extending section of said first helmet half;

c) securing means extending between said first helmet portion and said second helmet portion holding said two halves together in a releasable manner, said securing means comprising a plurality of pronged fingers extending from one of said first and second rigid helmet portions, a plurality of indentations in another of said first and second helmet portions, each of said plurality of indentations receiving a prong of one of said pronged fingers, a threaded fastener extending through each of the helmet portions to maintain engagement therebetween;

whereby, should a wearer of said helmet incur a head, neck or spinal injury, said securing means can be disengaged to permit said first and second helmet portions to be disassembled and removed without need for significant movement of the wearer's head.

* * * * *